US006727415B1

(12) United States Patent
Herring

(10) Patent No.: US 6,727,415 B1
(45) Date of Patent: Apr. 27, 2004

(54) GUITAR REST

(76) Inventor: Shannon Herring, P.O. Box 2873, St. Francisville, LA (US) 70775

( * ) Notice: Subject to any disclaimer, the term of this patent is extended or adjusted under 35 U.S.C. 154(b) by 90 days.

(21) Appl. No.: 09/570,759

(22) Filed: May 15, 2000

Related U.S. Application Data

(60) Provisional application No. 60/133,903, filed on May 13, 1999.

(51) Int. Cl.[7] ..... G10D 13/02
(52) U.S. Cl. ..... 84/411 R
(58) Field of Search ..... 84/329, 327

(56) References Cited

U.S. PATENT DOCUMENTS 5,219,075 A * 6/1993 White ..... 206/314
5,375,497 A * 12/1994 Pirchio et al. ..... 84/327
5,497,689 A * 3/1996 Hoshino ..... 84/327
5,616,874 A * 4/1997 Kraus et al. ..... 84/327
5,911,396 A * 6/1999 Birely ..... 248/340
5,986,193 A * 11/1999 Garrison ..... 84/327
6,130,375 A * 10/2000 Kellogg et al. ..... 84/327

* cited by examiner

*Primary Examiner*—Kimberly Lockett
(74) *Attorney, Agent, or Firm*—Garvey, Smith, Nehrbass & Doody, L.L.C.; Seth M. Nehrbass

(57) ABSTRACT

A rest for guitar-like instruments is internally configured to receive the bottom of a guitar-like instrument and to allow the instrument to lean against another object. Preferably, a groove is provided in the bottom of the rest to allow the rest to fit over the handle of an amplifier. Also, the cavity is preferably shaped such that the back of the top of the guitar-like instrument leans on a wall or other supporting structure.

15 Claims, 9 Drawing Sheets

GUITAR REST

CROSS-REFERENCE TO RELATED APPLICATIONS

Priority of my U.S. Provisional Patent Application Serial No. 60/133,903, filed May 13, 1999, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to accessories for musical instruments More particularly, the present invention relates to guitar accessories.

2. General Background of the Invention

Contemporary instrument stands are designed to totally support the weight and balance of an instrument (freestanding or hanging). Generally made from heavy steel tubing or hardened plastics, they generally require some assembly plus take up a lot of floor space and have a tendency to become tripping hazards or snag points, leaving a sense of insecurity for the instrument.

The following U.S. Patents are incorporated herein by reference: U.S. Pat. Nos. 4,099,441; 4,223,785; 4,474,290; 4,515,272; 5,024,328; 5,029,796; 5,149,901; 5,207,327; 5,497,689; 5,590,771; 5,713,465; 5,816,395; 5,833,051; and 5,876,813. Also incorporated by reference is UK Patent Application No. GB 2 276 314 and the references cited therein and in the U.S. Patents mentioned above.

BRIEF SUMMARY OF THE INVENTION

The present invention is a rest for guitar-like instruments which is internally configured to receive the bottom of a guitar-like instrument and to allow the instrument to lean against another object. Preferably, a groove is provided in the bottom of the rest to allow the rest to fit over the handle of an amp (though the amp handle groove dimensions will vary based on the style of amp handle and type of instrument for which the rest is designed - some models of the rest of the present invention will be designed without an amp handle groove). Also, the cavity is preferably shaped such that the back of the top of the guitar-like instrument leans on the wall or other supporting structure.

The instrument rest of the present invention can be designed to fit any commercially available guitar or other stringed instrument, or other musical instruments.

The outside of the instrument rest of the present invention can be square, rounded, or sculpted to basically any size or shape.

Some light guitar-like instruments will stand up in the instrument rest of the present invention with no other support.

The present invention also comprises a neck support cushion, which is preferably used with the instrument rest of the present invention.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

The Instrument Rest method

Figure 1:
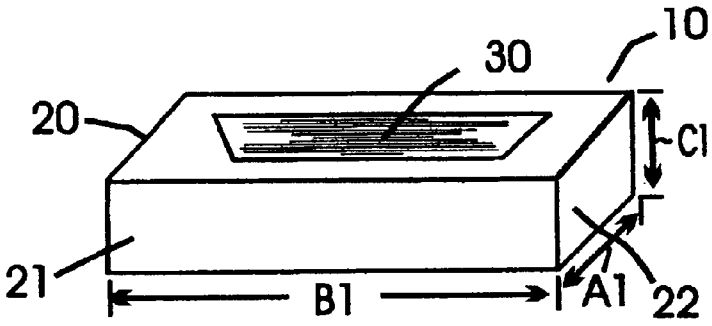
FIG. 1 is a perspective view of the preferred embodiment of the apparatus of the present invention.
Figure 2:
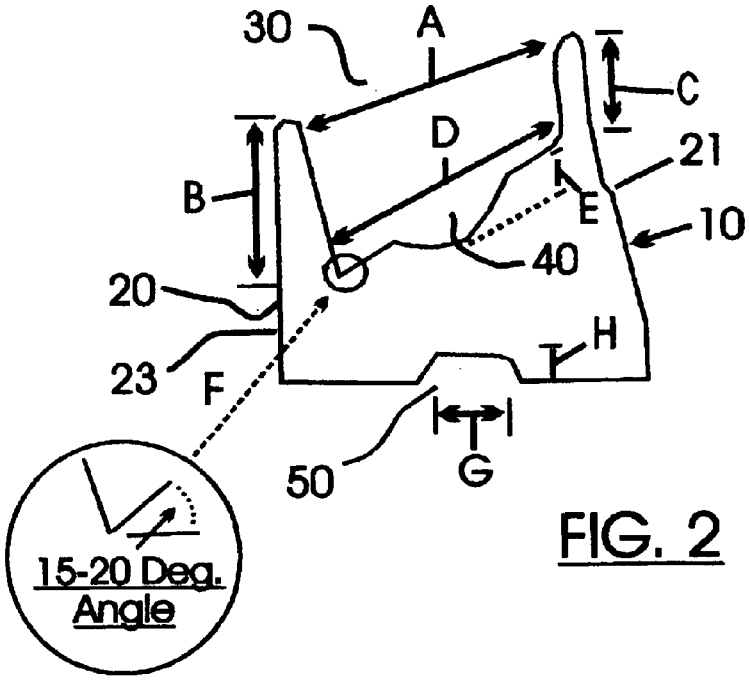
FIG. 2 is a cross-sectional view of the preferred embodiment of the apparatus of the present invention, taken along the lines II—II in FIG. 6.
Figure 3:
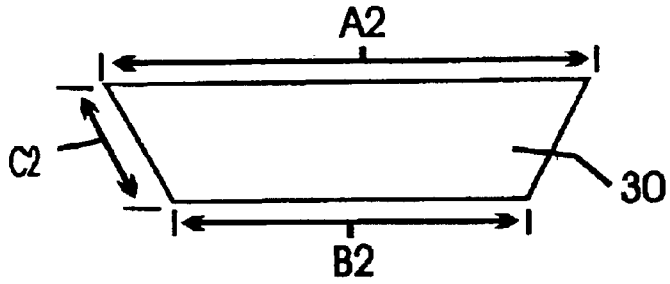
FIG. 3 is a top view of the preferred embodiment of the apparatus of the present invention.
Figure 4:
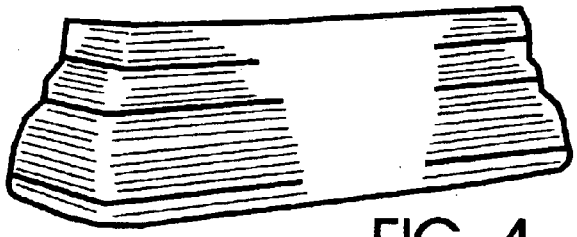
FIG. 4 is a perspective view of the preferred embodiment of the apparatus of the present invention.
Figure 5:
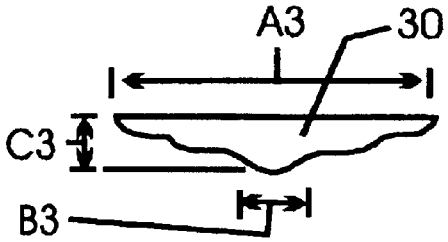
FIG. 5 is a cross-sectional view of the cavity of the preferred embodiment of the apparatus of the present invention, taken along the lines V—V in FIG. 6.
Figure 6:
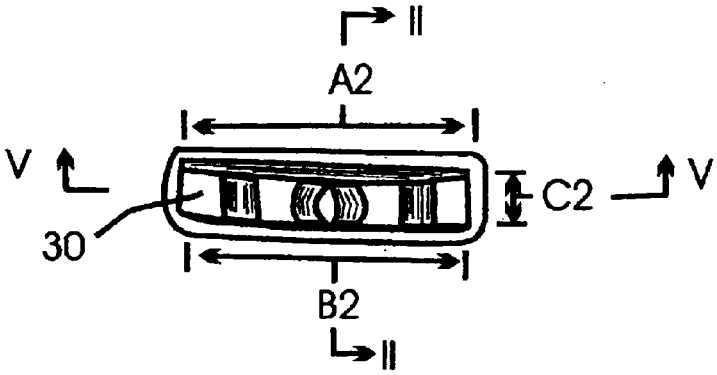
FIG. 6 is a top view of the preferred embodiment of the apparatus of the present invention.
Figure 7:
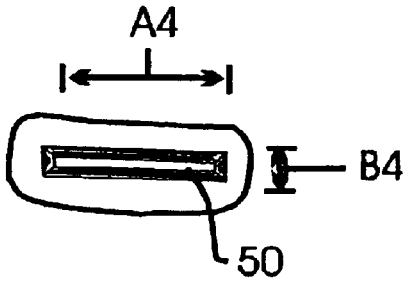
FIG. 7 is a bottom view of the preferred embodiment of the apparatus of the present invention.
Figure 8:
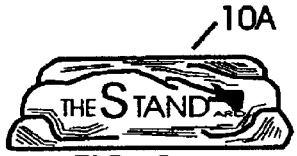
FIGS. 8–28 are views of various ornamental designs for the outside of the present invention.
Figure 9:
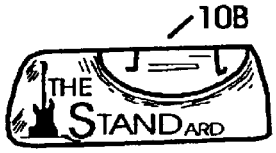
Figure 10:
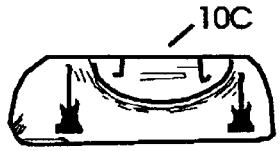
Figure 11:
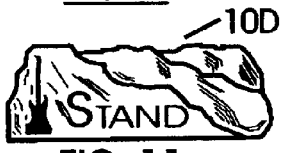
Figure 12:
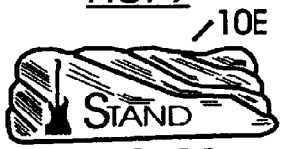
Figure 13:
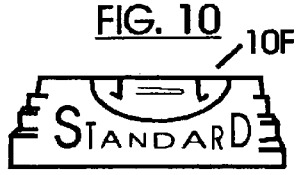
Figure 14:
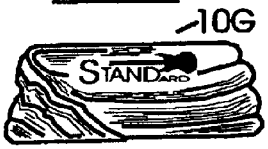
Figure 15:
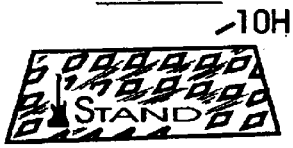
Figure 16:
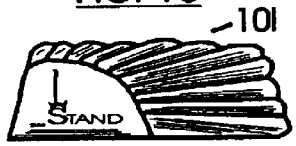
Figure 17:
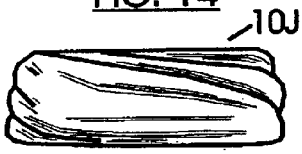
Figure 18:
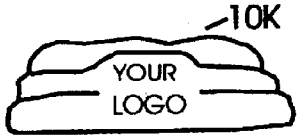
Figure 19:
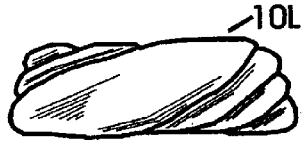
Figure 20:
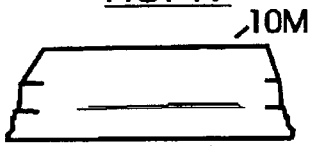
Figure 21:
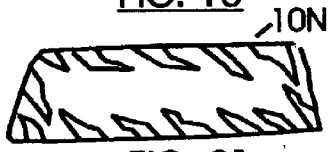
Figure 22:
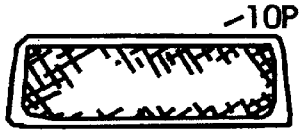
Figure 23:
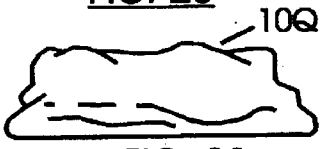
Figure 24:
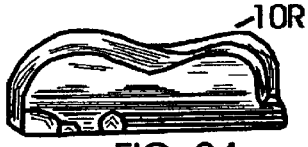
Figure 25:
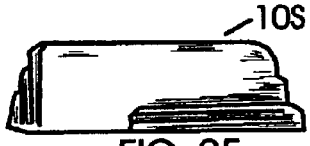
Figure 26:
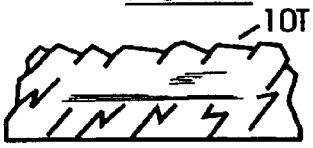
Figure 27:
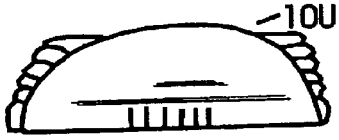
Figure 28:
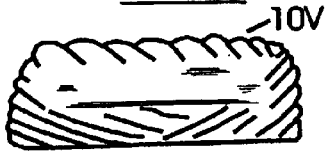
Figure 29:
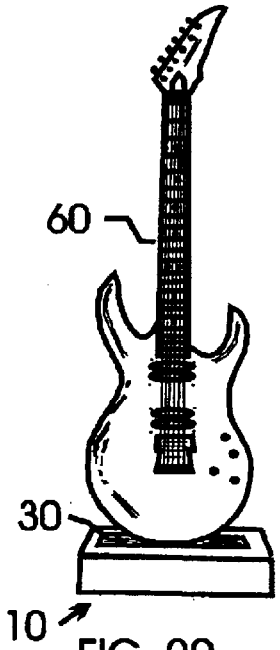
FIG. 29 is a perspective view of the preferred embodiment of the apparatus of the present invention with an electric guitar being inserted therein.
Figure 30:
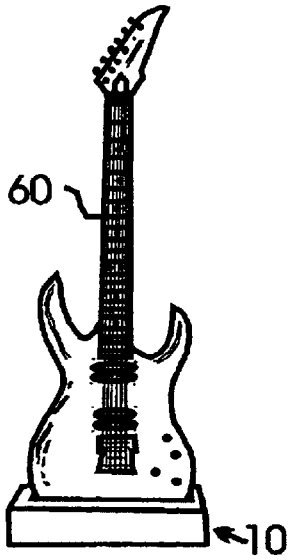
FIG. 30 is a perspective view of the preferred embodiment of the apparatus of the present invention with an electric guitar inserted therein.
Figure 31:
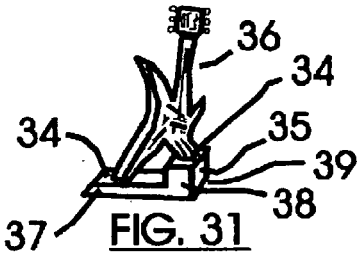
FIG. 31 is a perspective view of an alternative embodiment of the apparatus of the present invention with a stringed instrument inserted therein.
Figure 32:
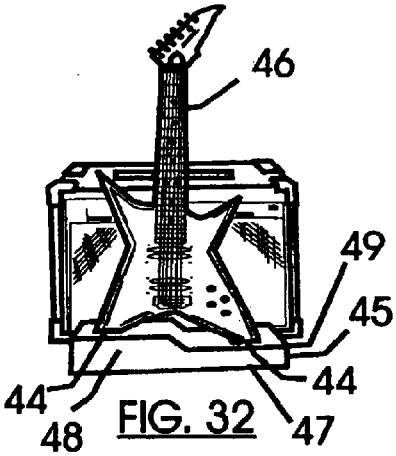
FIG. 32 is a perspective view of an alternative embodiment of the apparatus of the present invention with a guitar inserted therein and leaning against an amp.
Figure 33:
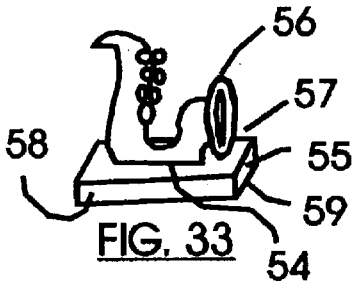
FIG. 33 is a perspective view of an alternative embodiment of the apparatus of the present invention with a horn inserted therein.
Figure 35:
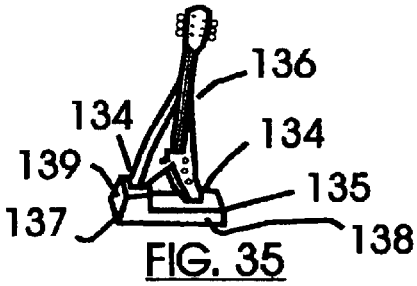
FIG. 35 is a perspective view of an alternative embodiment of the apparatus of the present invention with a stringed instrument inserted therein.
Figure 34:
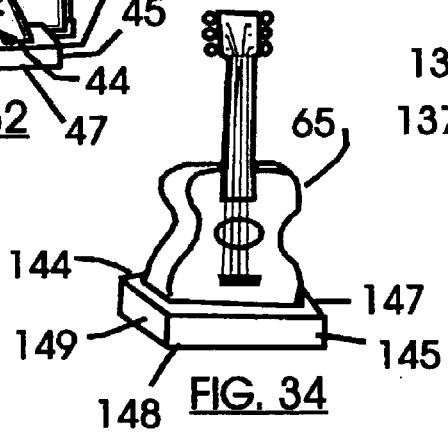
FIG. 34 is a perspective view of an alternative embodiment of the apparatus of the present invention with a box guitar inserted therein.
Figure 36:
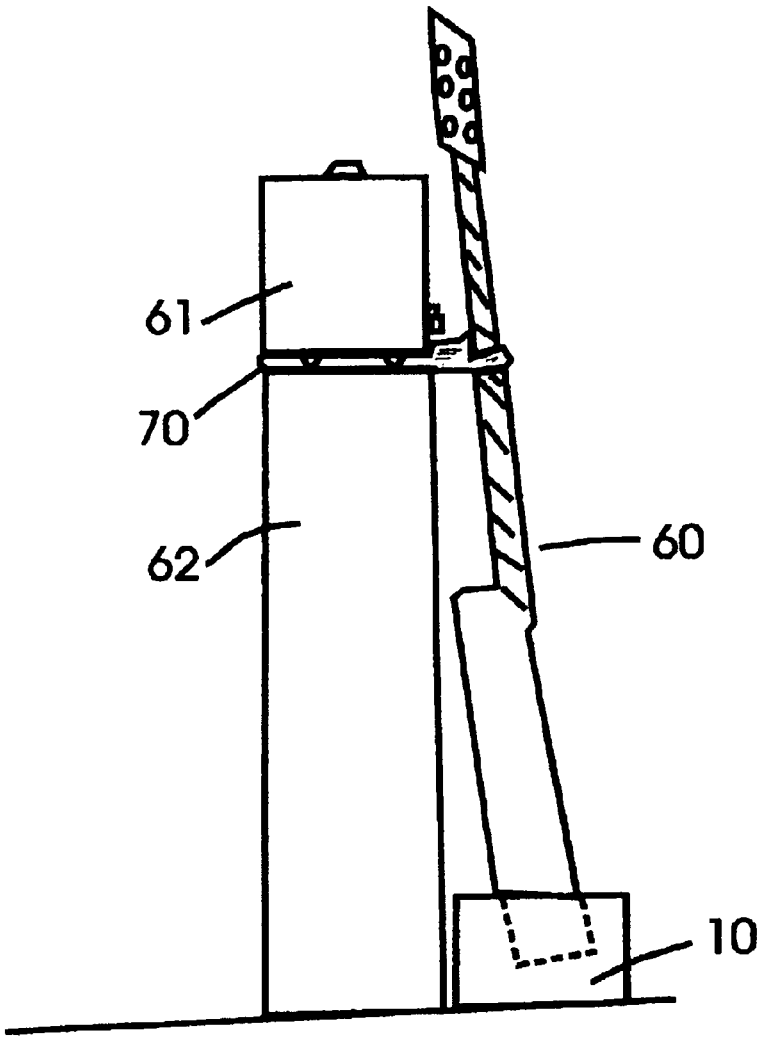
FIG. 36 is a side view showing the preferred embodiment of the apparatus of the present invention with an electric guitar inserted therein, and the guitar leaning against a neck rest pad of the preferred embodiment of the present invention.
Figure 37:
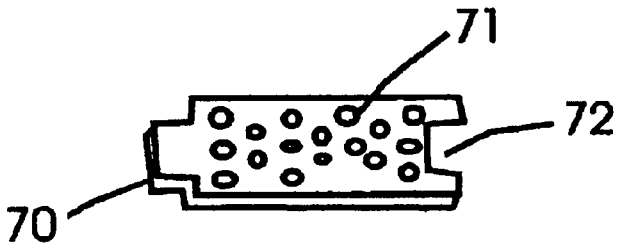
FIG. 37 is a top view of the neck rest pad of the preferred embodiment of the present invention.
Figure 38:
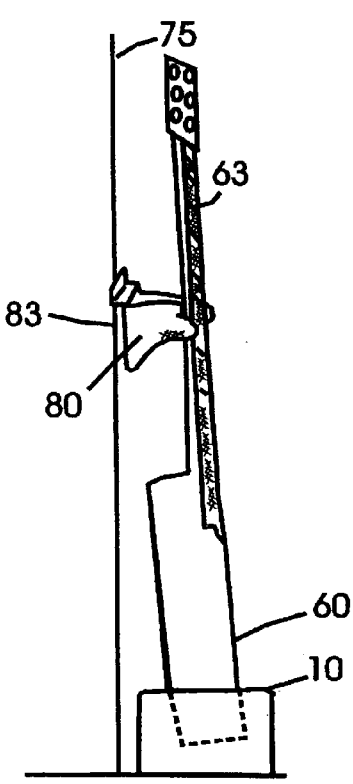
FIG. 38 is a side view showing the preferred embodiment of the apparatus of the present invention with an electric guitar inserted therein, and the guitar leaning against a keyboard neck rest pad of the preferred embodiment of the present invention.
Figure 40:
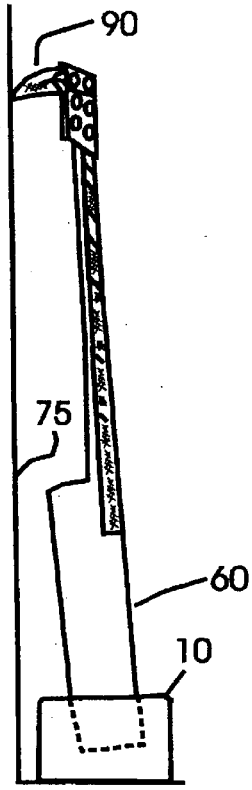
FIG. 40 is a side view showing the preferred embodiment of the apparatus of the present invention with an electric guitar inserted therein, and the guitar leaning against a headstock rest pad of the preferred embodiment of the present invention.
Figure 43:
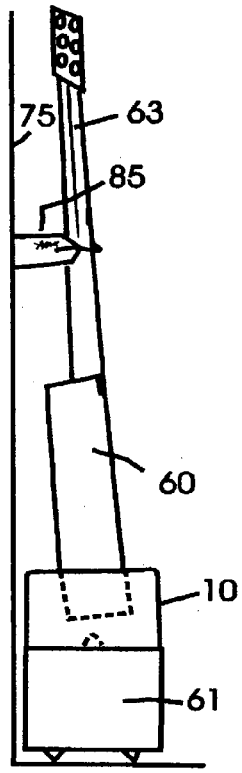
FIG. 43 is a side view showing the preferred embodiment of the apparatus of the present invention sitting on an amp and with an electric guitar inserted therein, and the guitar leaning against a keyboard neck rest pad of an alternative embodiment of the present invention.
Figure 39:
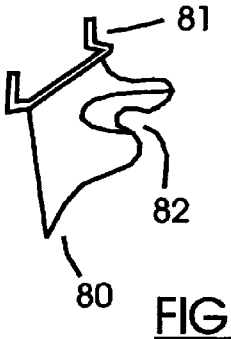
FIG. 39 is a perspective view of the keyboard neck rest pad of the preferred embodiment of the present invention.
Figure 41:
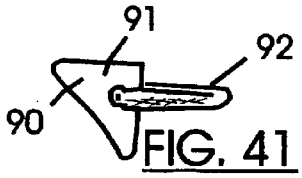
FIG. 41 is a side view of the headstock rest pad of the preferred embodiment of the present invention.
Figure 42:
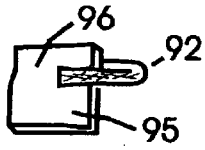
FIG. 42 is a side view of a headstock rest pad of an alternative embodiment of the present invention.
Figure 44:
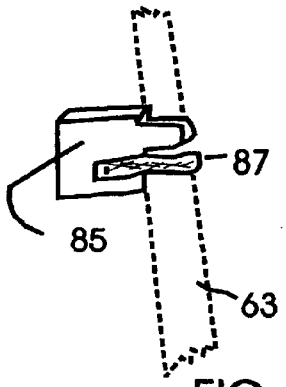
FIG. 44 is a perspective view of the keyboard neck rest pad of an alternative embodiment of the present invention.
Figure 45:
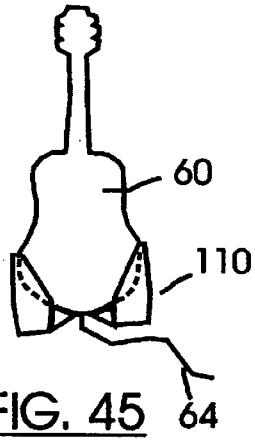
FIG. 45 is a front view of a guitar rest of an alternative embodiment of the present invention, with a guitar therein.
Figure 46:
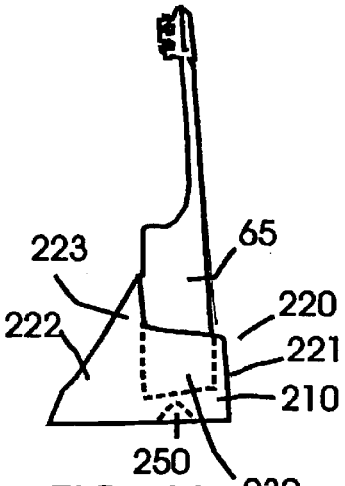
FIG. 46 is a side view of a guitar rest of an alternative embodiment of the present invention, with a guitar therein.
Figure 47:
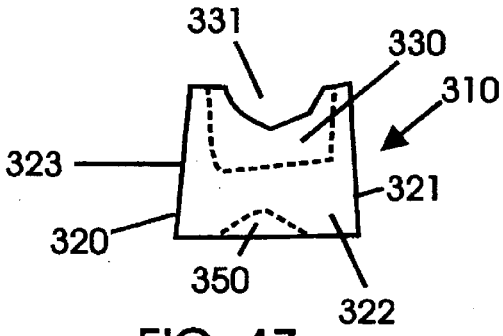
FIG. 47 is a side view of a guitar rest of an alternative embodiment of the present invention.
Figure 49:
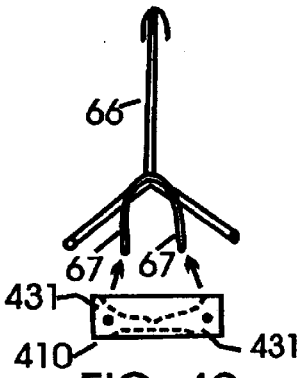
FIG. 49 is a front view of the guitar rest of a FIG. 48 and a tripod stand.
Figure 48:
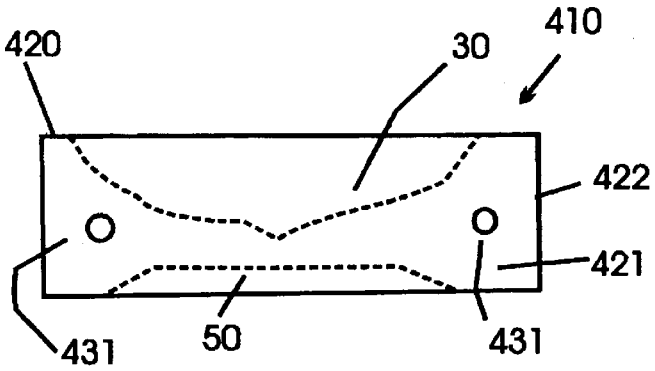
FIG. 48 is a front view of a guitar rest of an alternative embodiment of the present invention.
Figure 50:
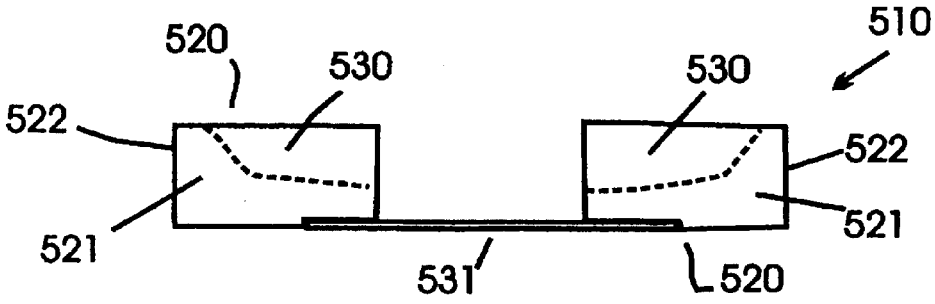
FIG. 50 is a front view of a guitar rest of an alternative embodiment of the present invention.
Figure 51:
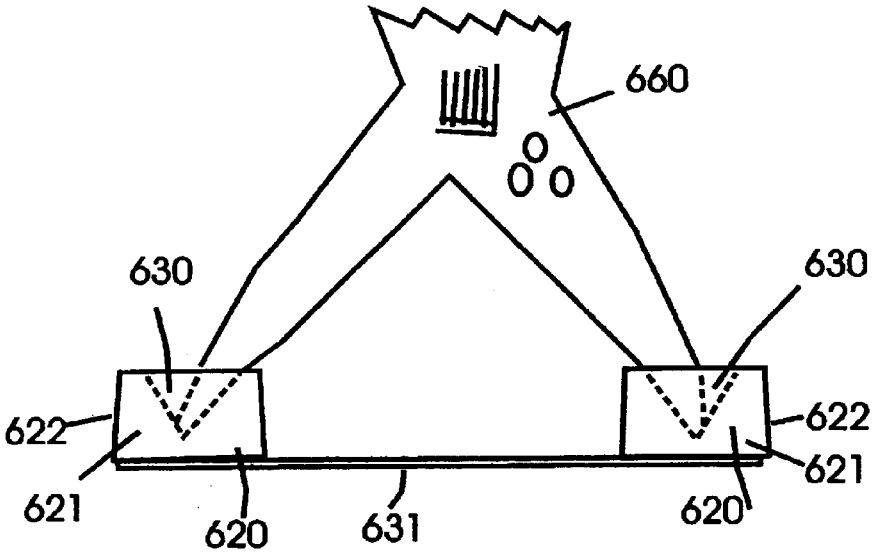
FIG. 51 is a front view of a guitar rest of an alternative embodiment of the present invention.
Figure 52:
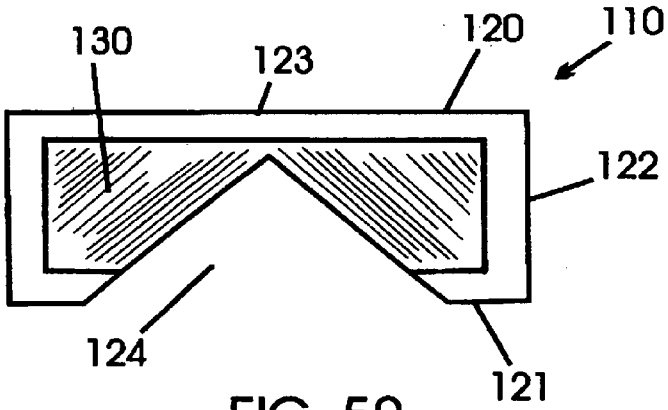
FIG. 52 is a top view of the guitar rest of the present invention shown in FIG. 45.
Figure 53:
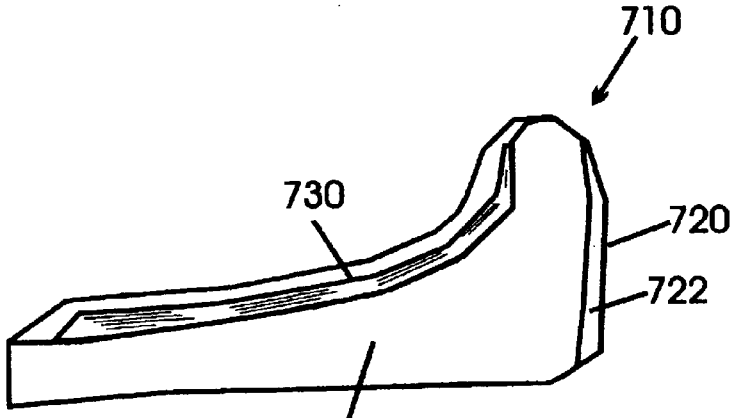
FIGS. 53–56 are front perspective views of guitar rests of alternative embodiments of the present invention.
Figure 54:
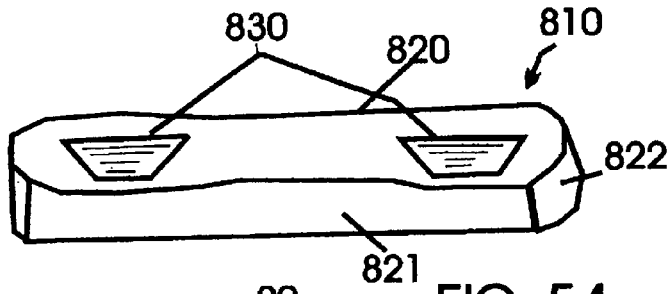
Figure 55:
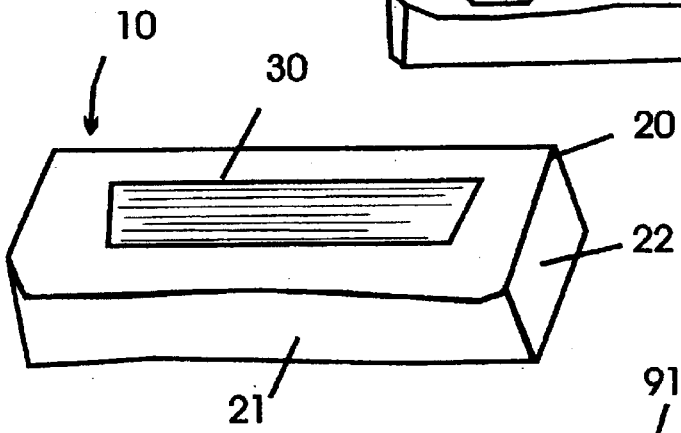
Figure 56:
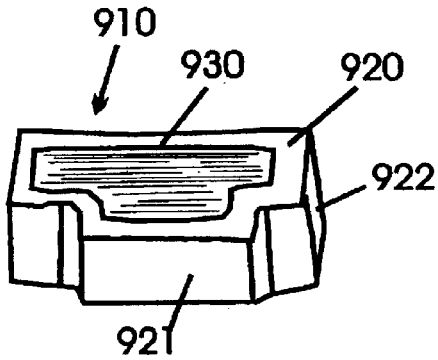

The instrument rest of the present invention is a unique style of stand for guitars or other instruments that uses a different concept from all other stands of today. The instrument rest of the present invention is a holder or rest for guitars and other instruments.

Functionality

The instrument rest of the present invention is designed so that a musician can rest the bottom of an instrument on/in the rest, while resting the neck and/or headstock backwards against another object (such as an amplifier, speaker, chairs or even just a bare wall).

Material Composition

The instrument rest of the present invention is preferably made of either a molded polyurethane foam, ester#3, urethane foam, #1570bl, or some similar but not always chemically the same as, yet providing a similar working effect of, a foam type material, and may consist of several different compounds all together.

Specifications

The instrument rest of the present invention is designed to hold a wide range of instruments no matter the shape, size or weight (electric guitars, box guitars, bass guitars, violins, horns, etc.). Factors such as color, density, texture and actual dimensions will be determined upon manufacture and will be influenced by the type of instrument for which the rest is designed.

Features and Benefits

The instrument rest of the present invention will eliminate the sense of insecurity and inconvenience of contemporary stands, by allowing the musician to rest his or her instrument in places not allowed by contemporary stands (on top of amps, behind or beside amps, behind doors, on shelves—just about anywhere where conventional stands will not fit, the instrument rest of the present invention will).

The instrument rest of the present invention will accommodate instruments that do not fit properly in contemporary stands.

The instrument rest of the present invention is preferably of one-piece construction, and is preferably compact and lightweight.

The uniqueness of the design of the instrument rest of the present invention allows for better weight support, superb balancing, and convenience of placement for an instrument.

The instrument rest of the present invention can be carried in most standard guitar cases, without damaging the instrument.

The instrument rest of the present invention will protect the finish of the instrument, by virtue of its design.

The instrument rest of the present invention can be made in extreme color variations, and in unique designs.

When using the instrument rest of the present invention, usually the instrument must be leaned against another object—the instrument rest of the present invention is usually not designed to solely support the instrument (it usually does not make the instrument free-standing—though some light guitar-like instruments will stand up in the instrument rest of the present invention with no other support).

The instrument rest of the present invention provides a lean-anywhere resting place.

The instrument rest of the present invention frees up valuable floor space.

The instrument rest of the present invention is compact, lightweight and durable.

The instrument rest of the present invention is preferably colorful and stylish, with a leather-like feel (when made with molded urethane foam, for example).

Cords will never tangle on the instrument rest of the present invention.

No assembly is required for standard models of the instrument rest of the present invention.

The strap pin locations will vary in location, size, and number.

As used herein, "guitar-like instrument" refers to stringed musical instruments such as electric guitars, box guitars, bass guitars, banjoes, mandolins, fiddles, violins, but excluding free-standing instruments such as harps.

PARTS LIST

The following is a list of parts and materials suitable for use in the present invention:

10 instrument rest of the preferred embodiment of the present invention 10A–10N and 10P–10V are instrument rests of alternative embodiments of the present invention
20 rest body
21 front of rest body
22 side of rest body
23 rear of rest body
30 cavity for receiving guitar-like instrument
34 cavity for receiving guitar-like instrument
35 instrument rest of an alternative embodiment of the present invention
36 guitar
37 rest body

38 front of rest body 37
39 side of rest body 37
40 groove for strap pin
44 cavity for receiving guitar-like instrument
45 instrument rest of an alternative embodiment of the present invention
46 guitar
47 rest body
48 front of rest body 37
49 side of rest body 37
50 groove for amp handle
54 cavity for receiving musical instrument
55 instrument rest of an alternative embodiment of the present invention
56 musical instrument
57 rest body
58 front of rest body 37
59 side of rest body 37
60 electric guitar
61 amp
62 speaker
63 neck of electric guitar 60
64 cords of guitar 60
65 box guitar
66 tripod stand
67 forks of tripod stand 66
70 neck rest pad of the preferred embodiment of the present invention (can be compressed between amp 61 and speaker 62)
71 compression holes in neck rest pad 70 (will vary in size and quantity)
72 neck support area of neck rest pad 70
75 wall
80 pegboard neck rest pad
81 metal pegboard hooks of pad 80
82 neck support area of neck rest pad 80
83 pegboard
85 neck rest pad
86 neck support area of neck rest pad 85
87 strap of neck rest pad 85 (preferably nylon or Velcro brand hook-and-loop fastener material)
90 headstock rest pad of the preferred embodiment of the present invention
91 headstock support area of headstock rest pad 90
92 strap of headstock rest pad 90 (preferably nylon)
95 headstock rest pad of an alternative embodiment of the present invention
96 headstock support area of headstock rest pad 95
110 freestanding guitar rest of an alternative embodiment of the present invention (it cradles more of the guitar than a standard rest 10)
120 rest body
121 front of rest body
122 side of rest body
123 rear of rest body
124 V-notch to allow for cords 64
130 cavity for receiving guitar-like instrument
134 cavity for receiving guitar-like instrument
135 instrument rest of an alternative embodiment of the present invention
136 guitar
137 rest body
138 front of rest body 137
139 side of rest body 137
144 cavity for receiving guitar-like instrument
145 instrument rest of an alternative embodiment of the present invention
147 rest body
148 front of rest body 147
149 side of rest body 147
210 instrument rest of an alternative embodiment of the present invention
220 rest body
221 front of rest body
222 side of rest body
223 raised rear of rest body to provide upright support
230 cavity for receiving guitar-like instrument
250 groove for amp handle
310 instrument rest of an alternative embodiment of the present invention
320 rest body
321 front of rest body
322 side of rest body
323 raised rear of rest body to provide upright support
330 cavity for receiving guitar-like instrument
331 cord recess to allow for cord for side-jacked instruments
350 groove for amp handle
410 instrument rest of an alternative embodiment of the present invention
420 rest body
421 front of rest body
422 side of rest body
431 tripod holes preferably completely through the body 420 to allow rest 410 to be slipped onto a conventional forked tripod stand 66
510 instrument rest of an alternative embodiment of the present invention
520 rest body
521 front of rest body
522 side of rest body
530 cavity for receiving guitar-like instrument
531 strap (nylon, e.g.) for connecting the left and right pieces of body 520
610 instrument rest of an alternative embodiment of the present invention
620 rest body
621 front of rest body
622 side of rest body
630 cavity for receiving guitar-like instrument
631 strap (nylon, e.g.) for connecting the left and right pieces of body 520
660 guitar
710 instrument rest of an alternative embodiment of the present invention
720 rest body
721 front of rest body
722 side of rest body
730 cavity for receiving guitar-like instrument
810 instrument rest of an alternative embodiment of the present invention
820 rest body
821 front of rest body
822 side of rest body
830 cavity for receiving guitar-like instrument
910 instrument rest of an alternative embodiment of the present invention
920 rest body
921 front of rest body
922 side of rest body
930 cavity for receiving guitar-like instrument Dimensions (Potential Approximate Preferred Ranges)

A 0.5" to 22.0"
B 0.125" to 18.0"

C 0.125" to 16.0"
D 0.5" to 22.0"
E 0.0" to 8.0"
F 0 to 60 Degrees
G 0.0" to 2.5"
H 0.0" to 2.0"
A1 1.0" to 26.0"
B1 3.0" to 38.0"
C1 1.25" to 24.0"
A2 2.0" to 38.0"
B2 2.0" to 38.0"
C2 0.5" to 22.0"
A3 2.0" to 38.0"
B3 0.0" to 38.0"
C3 0.125" to 16.0"
A4 0.0" to 15.0"
B4 0.0" to 2.5"

This product may optionally have an exterior coating applied depending upon the type of foam used by the manufacturer. The coatings may vary from a urethane to a synthetic cloth type material depending on coatings market technology.

The following are exemplary values for the following dimensions of the rest when used with a standard electric guitar:

A—2.065"
B—1.750"
C—1.500"
D—1.935"
E—0.625" (strap pin groove depth)
F—15–20 degrees (chosen to allow the instrument to rest in a backwards position, against another object)
G—1.250" (width of groove to fit over amplifier handle)
H—0.750" (depth of groove to fit over amplifier handle)
A1—4.500"
B1—12.500"
C1—3.500"
A2—10.125"
B2—9.875"
C2—2.062"
A3—10.125" (rear) —9.875" (front)
B3—2"
C3—2.375"
A4—11.0"
B4—1.937"

The following are exemplary values for the following dimensions of the rest when used with a standard large box guitar:

A—5.250"
B—2.125"
C—1.500"
D—5.000"
E—0.625"
F—15–20 degrees
G—1.250"
H—0.750"
A1—7.000"
B1—16.000"
C1—3.250"
A2—13.375"
B2—11.875"
C2—5.250"
A3—13.375" (rear)
—11.875" (front)
B3—2.000"
C3—2.375"
A4—11.0"
B4—1.937"

All measurements disclosed herein are at standard temperature and pressure, at sea level on Earth, unless indicated otherwise.

The foregoing embodiments are presented by way of example only; the scope of the present invention is to be limited only by the following claims.

What is claimed is:

1. Apparatus including a protective device for musical instruments comprising:

a soft bottom rest having an angled cavity for receiving a guitar-like instrument and allowing the guitar-like instrument to rest against a wall or other substantially vertical structure.

2. The apparatus of claim 1, further comprising:

the guitar-like instrument.

3. The apparatus of claim 1, further comprising:

a case for the guitar-like instrument.

4. The apparatus of claim 1, wherein:

the angled cavity is shaped to closely receive the bottom of the guitar-like instrument.

5. The apparatus of claim 1, wherein:

the guitar-like instrument is a guitar.

6. The apparatus of claim 1, further comprising:

a cavity for receiving an amp handle.

7. The apparatus of claim 1, further comprising:

a cushion for supporting the neck of a guitar.

8. The apparatus of claim 1, further comprising:

a cushion for supporting the headstock of a guitar.

9. Apparatus including a protective device for musical instruments comprising:

a soft bottom rest having an angled cavity for receiving a guitar-like instrument and allowing the guitar-like instrument to stand upright without resting against a wall or other substantially vertical structure.

10. The apparatus of claim 5, further comprising:

the guitar.

11. The apparatus of claim 10, wherein:

the angled cavity is shaped to closely receive the bottom of the guitar-like instrument.

12. The apparatus of claim 9, wherein:

the guitar-like instrument is a guitar.

13. The apparatus of claim 9, further comprising:

a cavity for receiving an amp handle.

14. The apparatus of claim 9, further comprising:

a cushion for supporting the neck of a guitar.

15. The apparatus of claim 9, further comprising:

a cushion for supporting the headstock of a guitar.

* * * * *